United States Patent [19]

Walker

[11] 4,253,354

[45] Mar. 3, 1981

[54] HYDRAULIC CATWORKS SYSTEM

[76] Inventor: James L. Walker, 305 Yorkshire La., Victoria, Tex. 77901

[21] Appl. No.: 74,706

[22] Filed: Sep. 12, 1979

[51] Int. Cl.[3] ..... B25B 13/50

[52] U.S. Cl. ..... 81/57.34; 81/57.39

[58] Field of Search ..... 81/57.33, 57.34, 57.35, 81/57.39

[56] References Cited

U.S. PATENT DOCUMENTS

| | | | |
|---|---|---|---|
| 883,630 | 3/1908 | Dunn | 81/57.33 |
| 1,625,528 | 4/1927 | Erwin et al. | 81/57.35 |
| 1,736,009 | 11/1929 | Nixon | 81/57.34 |
| 2,454,317 | 11/1948 | Hambly | 81/57.35 |

*Primary Examiner*—James L. Jones, Jr.
*Attorney, Agent, or Firm*—Fulbright & Jaworski

[57] ABSTRACT

A hydraulic catworks system for use on a well drilling rig for making up and breaking out a drill string which includes a hydraulic makeup piston and cylinder assembly for actuating a makeup line connected to the makeup tongs, and a breakout piston and cylinder assembly connected to a breakout line for actuating the breakout tongs. A makeup hydraulic control valve controls hydraulic fluid to first and second lines connected to the makeup assembly with the first line connected for extending the makeup line and the second line connected for retracting the makeup line. A breakout hydraulic control valve controls fluid to third and fourth lines with the third line connected for extending the breakout line and the fourth line connected for retracting the breakout line. Manual air control means are provided for selectively actuating the makeup and breakout control valves. A variable pressure control is connected to the second line for controlling the makeup torque. Preferably, the makeup and breakout assemblies are vertically connected to the legs of the drilling rig and rollers are positioned horizontally with the makeup and breakout tongs and connected to the breakout and makeup lines. Preferably, a sheave is connected to the makeup assembly and the makeup line passes over the sheave with its free end fixedly secured. A re-generative system is provided on the makeup assembly for increasing the speed of the makeup line extension. Preferably the makeup and breakout cylinders are of the same cross-sectional area with the stroke of the breakout cylinder being less than the stroke of the makeup cylinder.

9 Claims, 6 Drawing Figures

10

12
TONG OPERATOR (1)
14
BREAK-OUT WORK AREA
54'
MAKE-UP WORK AREA
54'
18
16
TONG OPERATOR (2)
SPINNING CHAIN
OPERATOR CONSOLE
20
22
82
24
32
30
GUIDE ROLLER
GUIDE ROLLER 66
68
70
72
74
76
100
96
26
98
28
27
29
77
78
80
79
94
90
102
62
54
60
58
86
88
56
84
52
50
64

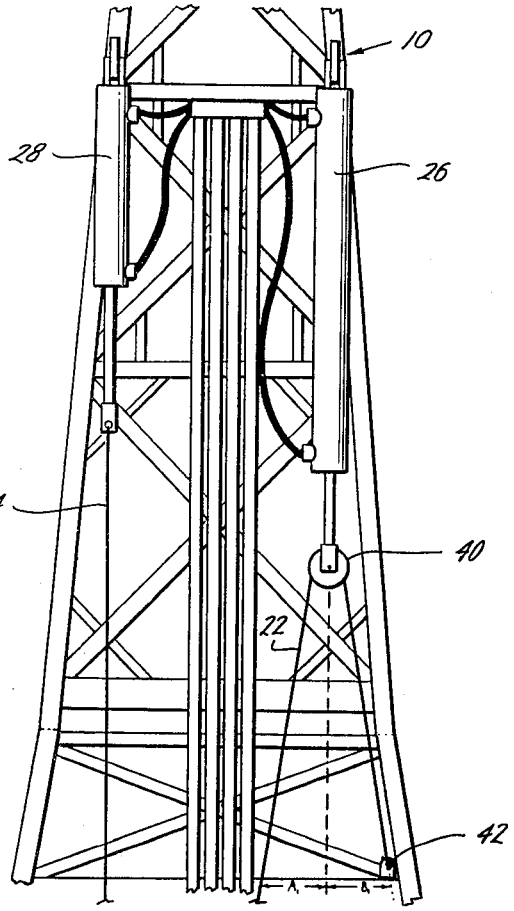
Fig. 5
Fig. 6
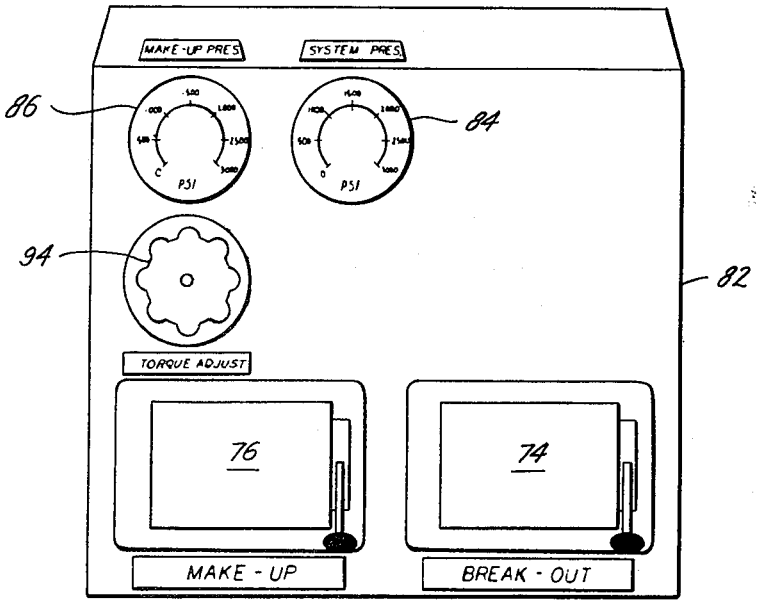

HYDRAULIC CATWORKS SYSTEM

BACKGROUND OF THE INVENTION

Conventional catwork systems now being used throughout the oil and gas drilling industry have proven useful, but often very dangerous. A pull chain is actuated by a rotating drum and when engaged the pipe tongs are jerked, sometimes snapping the chain and causing possible serious injury, and is not satisfactorily controlled.

The present invention is directed to a hydraulic catworks system in which the pulling lines on the pipe makeup and breakout tongs provide a smooth and controlled force to provide a safe, reliable and controlled operation.

SUMMARY

The present invention is directed to a hydraulic catworks system for use on an oil and gas drilling rig for actuating the makeup and breakout tongs for making up and breaking out a drill string and includes a hydraulic makeup piston and cylinder assembly and a breakout piston and cylinder assembly for actuating the makeup and breakout lines and in turn the makeup and breakout tongs. Hydraulic control valves control the actuation of the makeup and breakout assemblies and means are provided for selectively actuating the control valves.

A still further object of the present invention is the provision of a hydraulic control system for actuating and controlling the makeup and breakout assemblies. First and second hydraulic lines are connected between the makeup assembly and a makeup control valve with the first line connected for extending the makeup line and the second line connected for retracting the makeup line. A variable pressure control means is connected to the second line for controlling the makeup torque applied to the drill string. This insures that a consistent torque is applied throughout the drill string, reduces wear on the pipe threads, and lessens the possibility of line breakage from over-torquing on the drill string.

A still further feature of the present invention is the provision of installing the makeup assembly and breakout assembly to the legs of the drilling rig out of the way, and passing the pull lines over rollers which are horizontally positioned at the work level of the makeup and breakout tongs.

Yet a still further object of the present invention is the provision of providing makeup and breakout cylinders of the same diameter with a sheave connected to the makeup assembly and the free end of the makeup line being fixedly secured whereby the makeup torque is always less than the available breakout torque.

Yet a still further object of the present invention is the provision of a hydraulically generative system connected to the makeup assembly which includes a fifth hydraulic line connected between the first and second hydraulic lines with an open-close valve positioned in the fifth line and a check valve connected in the second line thereby increasing the speed of the makeup line extension.

Yet a still further object of the present invention is the provision of a pneumatic control system for actuating and controlling the hydraulic control system.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIG. 5 is a fragmentary elevational view illustrating the connections of the makeup and breakout assemblies on the drilling rig, and FIG. 6 is an elevational view of the control panel of the hydraulic catworks system.

DESCRIPTION OF THE PREFERRED EMBODIMENT

Figure 1:
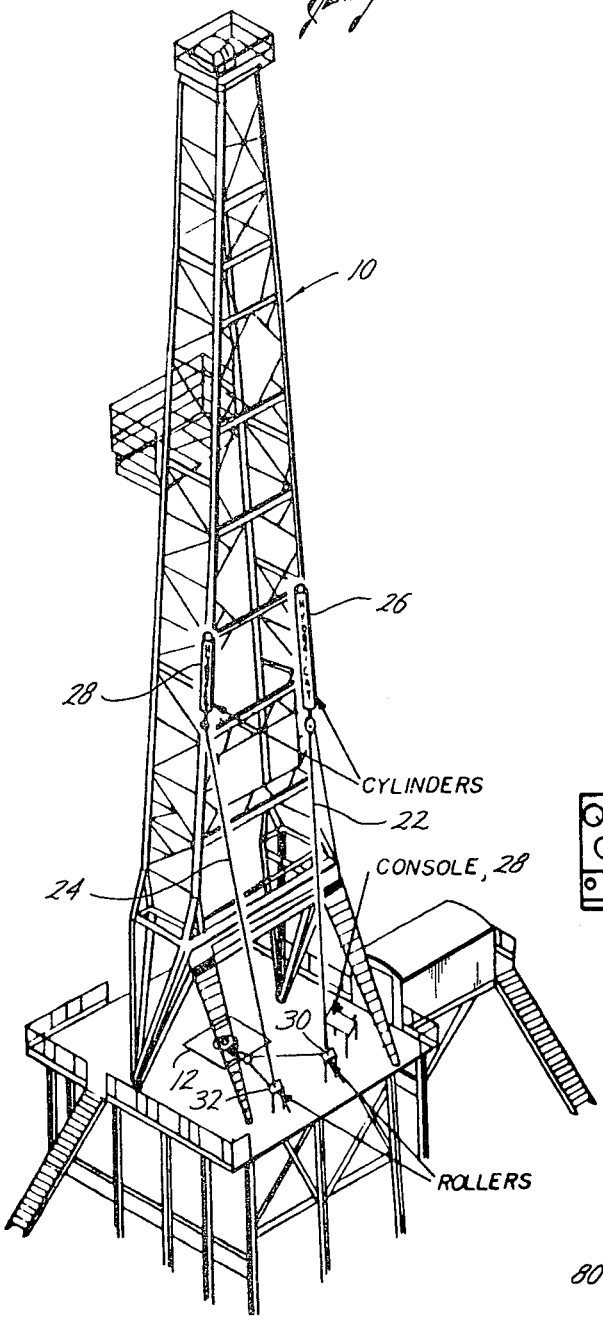
FIG. 1 is a perspective view of a drilling rig utilizing the hydraulic catworks system of the present invention.
Figure 3:
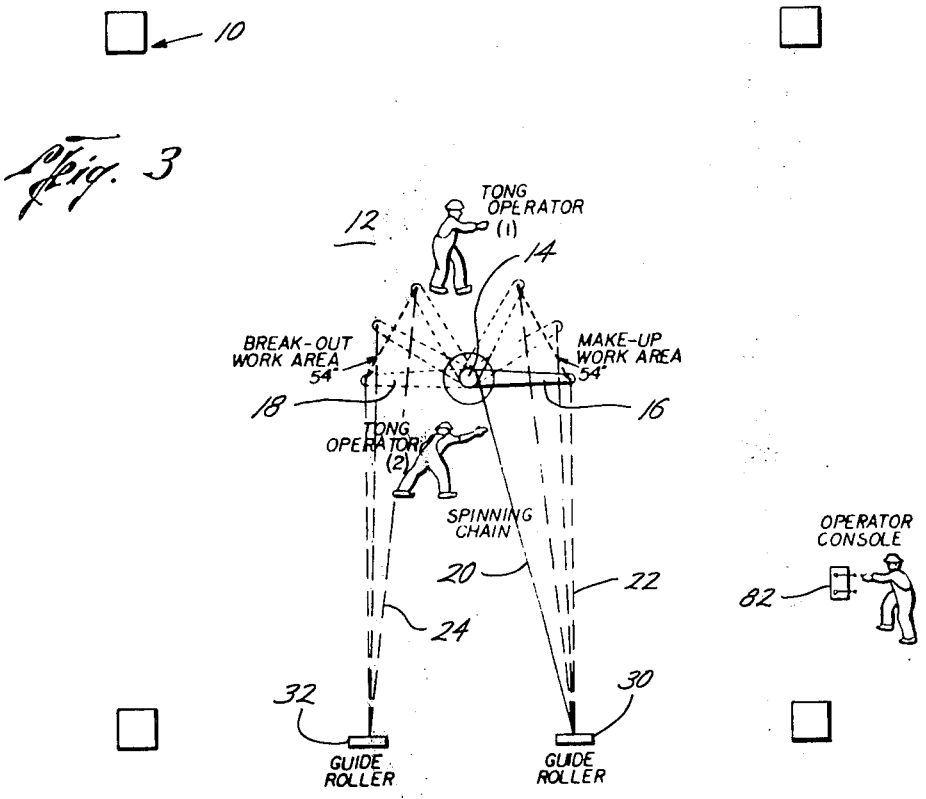
FIG. 3 is a schematic elevational view illustrating the actuation of the makeup and breakout tongs on the drilling string.

Referring now to the drawings, and particularly to FIGS. 1 and 3, the reference numeral 10 generally indicates a conventional oil and gas drilling rig having a floor 12 on which a plurality of joints of a drilling string, consisting of drill pipes and drill collars, are threadably assembled and disassembled while drilling a well therebelow. Referring to FIG. 3, the drilling string 14 is assembled by makeup means such as a makeup tong 16 which is rotated in a clock-wise direction to thread one joint of the drilling string 14 into another joint of the drilling string. Breakout means are provided such as breakout tongs 18 which are actuated in a counterclockwise direction for unthreading one joint of the drill string 14 from another joint of the drill string. In addition, a spinning chain 20 may also be utilized for makeup or for actuating the tongs. Generally in the past the makeup line 22 and the breakout line 24 have been actuated from the drum of a winch which has limited control and is subject to causing injury to workmen on the floor 12 in the event that the chain 20 or lines 22 and 24 are broken.

Figure 2:
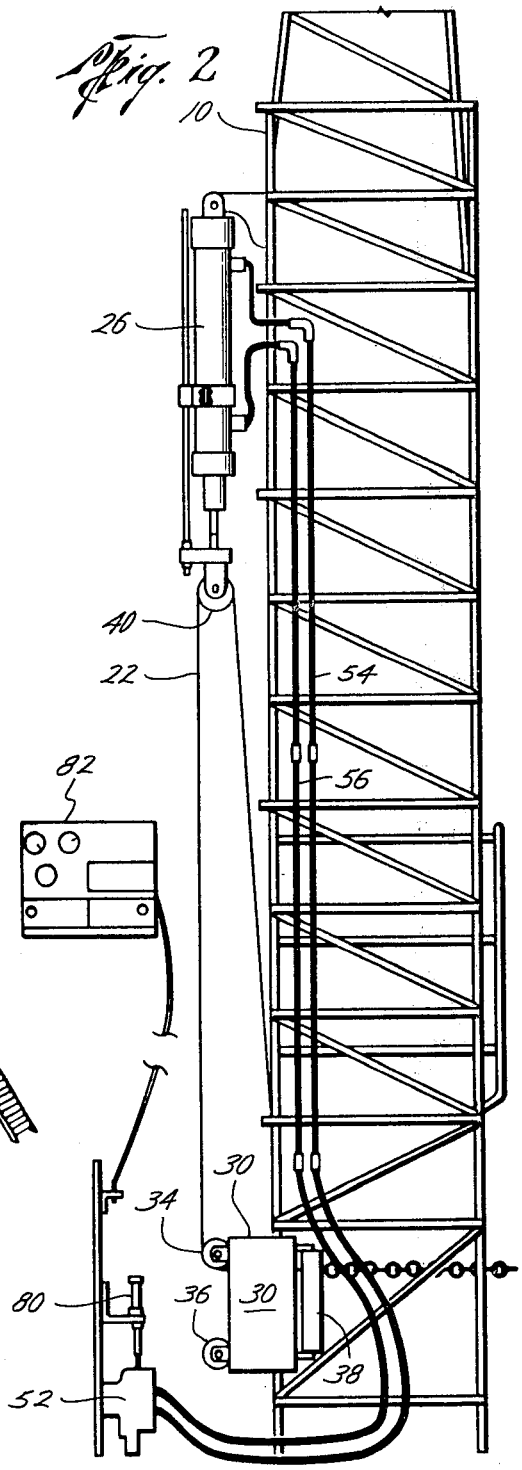
FIG. 2 is an enlarged side elevational view of a portion of the drilling rig off FIG. 1.

Referring to FIGS. 1, 2 and 5, a hydraulic control system is provided in which a hydraulic makeup piston and cylinder assembly 26 and a breakout piston and cylinder assembly 28 are provided for actuating the makeup line 22 and the breakout line 24, respectively. Preferably, the assemblies 26 and 28 are mounted to the legs of the drilling rig 10 by any suitable means such as by being bolted on or welded on brackets above the drilling floor 12 and thus do not require space on the crowded floor 12. The use of the hydraulic assemblies 26 and 28 for actuation of the lines 22 and 24 provide increased safety as should one of the lines or chains break in operation the broken line will drop to the rig floor 12 due to the smooth movement of the hydraulic assembly instead of being whipped around by a rotating drum. The lines 22 and 24 pass round rollers 30 and 32 which are positioned at the horizontal working level of the tongs 16 and 18. While the rollers 30 may be of any suitable configuration, preferably as best seen in FIG. 2, the rollers include a pair of horizontally disposed rollers 34 and 36 between which the lines pass and a pair of vertical rollers 38, only one of which is shown, between which the lines pass for suitably guiding the lines.

Preferably the breakout line 24 is connected directly to and in alignment with the breakout assembly 28, but the makeup line 22 passes over a sheave 40 connected to the makeup assembly 26 and the free end 42 of the makeup line 22 is fixedly secured to the rig 10 at an angle such that the resultant force on the sheave 40 is always in alignment with the makeup assembly 26. Since it is preferred that the diameter of the cylinders in the assemblies 26 and 28 are equal, the sheave 40 and makeup line 22 connection allows the retraction and extension of the makeup line 22 to be double the speed of the actuation and retraction of the breakout line 24 thereby insuring that the makeup speed is sufficiently fast to provide efficient and rapid actuation. Furthermore, this arrangement insures that for the same hydraulic pressure input to the assemblies 26 and 28 the makeup torque is one-half of the breakout torque thereby insuring that the pipe joints will always have an available breakout torque greater than the makeup torque. Additional sheave arrangements may be made to further insure the mechanical advantage of the system to increase its speed of operation. In addition, it is noted that the stroke of the makeup piston and cylinder assembly 26 is preferably much greater than the stroke of the breakout piston and cylinder assembly 28.

Figure 4:
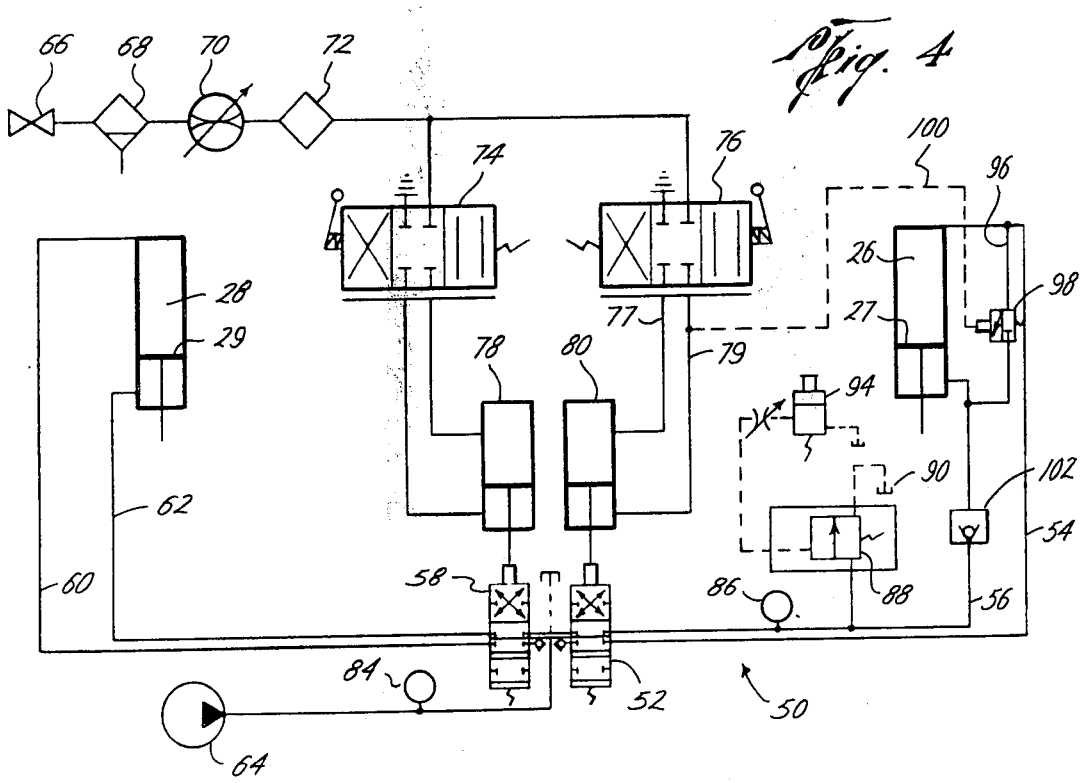
FIG. 4 is a pneumatic and hydraulic schematic of the control system of the present invention.

Referring now to FIGS. 2, 4 and 6, and particularly to FIG. 4, the control system for actuating the assemblies 26 and 28 is best seen and is generally indicated by the reference numeral 50. A makeup hydraulic control valve 52 is provided for controlling the makeup assembly 26 through a first line 54 which is connected to the assembly 26 behind the piston 27 for moving the piston and piston rod downwardly to extend the makeup line 22, and a second line 56 connected to the second side of the piston 27 for actuating the piston 27, its piston rod, and the makeup line 22 in a direction to retract the makeup line 22.

A breakout hydraulic control valve 58 is provided for controlling the breakout assembly 28 and is connected to a third hydraulic line 60 which is connected on a first side of the piston 29 to extend the piston 29, its piston rod and the breakout line 24 in a direction to extend the breakout line 24 and a fourth line 62 connected to the second side of the piston 29 to act on the piston 29 in a direction to retract the piston 29, its piston rod and the breakout line 24 in a retracting direction.

Valves 52 and 58 are four-way, three-position valves with the work ports blocked to flow when the spool is in the neutral position which are used in controlling and directing flow to double acting cylinders requiring push, pull and hold power actions and may be Model A35-DA53 sold by Commercial Shearing and Stamping Co.

The valves 52 and 58 are shown in the neutral position. The valves 52 and 58 may be selectively actuated to communicate fluid from a hydraulic pump 64 to one of the hydraulic lines. Thus valve 52 may be actuated in one direction to flow hydraulic fluid from the pump 64 through the line 56 to the assembly 26 for retracting the piston 27 and the makeup line 22 or the valve 52 may be moved in the opposite direction to transmit fluid through the first line 54 to the assembly 26 to move the piston 27 downwardly and extend the makeup line 22. Hydraulic control valve 58 may be similarly actuated to control the movement of the assembly 28 for extending and retracting the breakout line 24.

While the control valves 52 and 58 may be directly controlled, it is preferred to utilize air control valves for selectively actuating the hydraulic control valves 52 and 58. Thus a pneumatic control system is provided consisting of an air control valve 66, a filter 68, an air regulator 70, an air lubricator 72, a hand operated graduated air control valve 74 for the breakout control, a hand operated graduated air control valve 76 for the makeup system, an air cylinder 78 for controlling the hydraulic breakout control valve 58 and an air cylinder 80 for controlling the makeup hydraulic control valve 52. Air cylinder 78 and 80 may be of any suitable three-position, spring-centered air cylinder such as model P57378 sold by the Wabco Fluid Power Division of the American-Standard Company. The air control valves 74 and 76 may be of the type M sold by Wabco Fluid Power Division of Amercian-Standard Company. Actuation of the air control valves 74 and 76 control the positioning of the air cylinders 78 and 80, respectively, which in turn control the position of the hydraulic control valves 58 and 52, respectively.

Referring now to FIGS. 4 and 6, the control panel 82 includes in addition to the hand operated control valves 74 and 76 a main pressure gauge 84 showing the hydraulic pressure from the pump 64 which is also the pressure of the breakout assembly 28. A separate pressure gauge 86 may be provided connected to the second line 56 for measuring the pressure of the makeup torque applied to the makeup tongs. It is important to control and limit the makeup torque to prevent over-torquing on making up a joint. Therefore, a first relief valve 88 is provided connected to the second line 56 which provides for the makeup line retraction. The relief valve 88 may be of any suitable type which limits pressure in the line 56 by directing fluid flow to the tank 90 when the pressure in the line 56 reaches the setting of the valves and thereby prevents over-loading and over-torquing of the makeup system. Such a valve may be of the Model CT06-F40 sold by Sperry Vickers. In addition, a remote operator actuated relief valve 94 may be manually operated at the control panel 82 and is directly connected to relief valve 88 which provides a variable torque control that can provide a predetermined makeup of the drill pipe joints. Valve 94 may be model C-175-F-10 by Sperry Vickers. This insures a consistent torque throughout the pipe string, reduces wear on the pipe threads and lessens the possibility of chain or line breakage from over-torquing the drill pipe.

A still further feature of the present invention is the provision of a regenerative circuit on the makeup assembly 26 which provides for quick extension of the makeup assembly 26 and makeup line 22 to provide for increased speed of recovery of the hydraulic assembly 26. The regenerative system includes a fifth hydraulic line 96 connected between the first hydraulic line 54 and the second hydraulic line 56 or to the fluid inlet ports to the cylinder of the makeup assembly 26. A two-position open-closed valve 98 is positioned in the line 96 and may be actuated by an air control line 100 connected to the air control valve 76. In addition, a check valve 102 is provided in the second line 56 between the fifth line 96 and the control valve 52. When the makeup system is retracting the makeup line 22, the air control valve 76 is actuated to transmit air through line 77 to the air cylinder 80 to actuate the hydraulic control line 52 to move hydraulic fluid from the pump 64 through the line 56 through the check valve 102 and to the bottom of the piston 27 to retract the makeup line 22 and at this time the valve 98 is in the closed position. However, when it is desired to quickly extend the makeup line 22, the air control valve 76 is actuated to transmit air through line 79 to the air cylinder 80 to actuate the hydraulic control valve 52 to transmit hydraulic fluid from the pump 64 through the line 54. Also, transmission of air to the line 79 causes air to flow through line 100 to move the valve 98 to the open position. Piston 27 has a greater fluid area on its top than on its bottom because of the piston rod. Therefore, fluid from line 54 flows into the top of the piston 27 moving the piston downwardly and the fluid beneath the piston cannot return through line 56 because of the check valve 102 and thus the fluid will flow instead through the line 96 through the now opened valve 98. The fluid flowing through line 96 combines with the fluid flowing through line 54 onto the top of the piston 27 to increase the speed of extension of the piston rod and of the makeup line 22. The valve 98 may be any suitable two-position air actuated valve such as a Rego ball valve and actuator.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. A hydraulic catworks system for use on a well drilling rig for making up and breaking out a drill string comprising, a hydraulic makeup piston and cylinder assembly, a makeup line connected to said makeup assembly and adapted to be connected to makeup means, a breakout piston and cylinder assembly, a breakout line connected to said breakout assembly and adapted to be connected to breakout means, a makeup hydraulic control valve, a breakout hydraulic control valve, first and second hydraulic lines connected between the makeup assembly and the makeup control valve, said first line connected for makeup line extension and said second line connected for makeup line retraction, third and fourth hydraulic lines connected between the breakout assembly and the breakout control valve, said third line connected for breakout line extension and said fourth line connected for breakout line retraction, means for selectively actuating said makeup and said breakout control valves.

2. The apparatus of claim 1 including, variable pressure control means connected to the second hydraulic line for controlling the makeup torque applied to the drill string.

3. The apparatus of claim 1 wherein said makeup assembly and said breakout assembly are vertically connected to the legs of the drilling rig and rollers are connected to said makeup and breakout lines and positioned horizontally with said makeup and breakout means.

4. The apparatus of claim 1 wherein a sheave is connected to the makeup assembly and the makeup line passes over said sheave and its free end is fixedly secured.

5. The apparatus of claim 1 including a hydraulic regenerative system comprising, a fifth hydraulic line between said first and second hydraulic lines, an open-close valve positioned in said fifth line, and a check valve connected in the second line between the fifth line and the makeup control line allowing fluid to flow from the makeup control valve thereby increasing the speed of the makeup line extension.

6. The apparatus of claim 1 including, a relief valve connected to the second hydraulic line for limiting the torque of the makeup.

7. The apparatus of claim 1 including, manually actuated air control valves for actuating said makeup and said breakout control valves.

8. The apparatus of claim 4 wherein said makeup cylinder and said breakout cylinder are of the same cross-sectional area whereby the makeup torque is always less than the available breakout torque.

9. The apparatus of claim 8 wherein the stroke of the makeup cylinder is greater than the stroke of the breakout cylinder.

* * * * *